US006735925B2

(12) United States Patent
Weder et al.

(10) Patent No.: US 6,735,925 B2
(45) Date of Patent: May 18, 2004

(54) FLAT PANEL SLEEVE WITH FOLDED PORTIONS AND METHOD OF MANUFACTURING

(75) Inventors: Donald E. Weder, Highland, IL (US); Joseph G. Straeter, Highland, IL (US)

(73) Assignee: Southpac Trust International, Inc.

( * ) Notice: Subject to any disclaimer, the term of this patent is extended or adjusted under 35 U.S.C. 154(b) by 241 days.

(21) Appl. No.: 10/076,298

(22) Filed: Feb. 14, 2002

(65) Prior Publication Data

US 2003/0153448 A1 Aug. 14, 2003

(51) Int. Cl.[7] ..... B65B 61/14

(52) U.S. Cl. ..... 53/413; 53/459; 53/464; 493/408; 493/410

(58) Field of Search ..... 493/408, 410, 493/480; 53/413, 459, 464, 390, 592

(56) References Cited

U.S. PATENT DOCUMENTS

| | | | | |
|---|---|---|---|---|
| 1,044,260 | A | 11/1912 | Schloss | |
| 1,520,647 | A | 12/1924 | Hennigan | |
| 1,697,751 | A | 1/1929 | Blake | 229/87 |
| 1,794,212 | A | 2/1931 | Snyder | |
| 1,811,574 | A | 6/1931 | Barrett | |
| 1,863,216 | A | 6/1932 | Wordingham | |
| 2,170,147 | A | 8/1939 | Lane | 206/56 |
| 2,200,111 | A | 5/1940 | Bensel | 229/1.5 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,529,060 | A | 11/1950 | Trillich | 117/68.5 |
| 2,688,354 | A | 9/1954 | Berger | 150/28 |
| 2,774,187 | A | 12/1956 | Smithers | 47/41 |
| 2,796,700 | A | 6/1957 | Katz | |
| 2,989,828 | A | 6/1961 | Warp | 53/390 |
| 3,022,605 | A | 2/1962 | Reynolds | 47/58 |
| 3,094,810 | A | 6/1963 | Kalpin | 47/37 |
| 3,271,922 | A | 9/1966 | Wallerstein et al. | 53/3 |
| 3,316,675 | A | 5/1967 | Cartwright, Jr. | |
| 3,376,666 | A | 4/1968 | Leonard | 47/41 |
| 3,380,646 | A | 4/1968 | Doyen et al. | 229/57 |
| 3,431,706 | A | 3/1969 | Stuck | 53/390 |
| 3,512,700 | A | 5/1970 | Evans et al. | 229/53 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |

(List continued on next page.)

OTHER PUBLICATIONS

Santa Clara County Council: "Gateway to the Orient", Pow Wow 1999, Online!, Mar. 1999, URL:http://www.mac-scouter.com/CubScouts/PowWow99/SCCC/Mar2_00.pdf> 'retreived on Jul. 9, 2003!, p. 24, line 1–line 11.

Speed Cover Brochure, "The Simple Solution For Those Peak Volume Periods", Highland Supply Corporation, ©1989.

"Speed Sheets and Speed Rolls" Brochure, Highland Supply Corporation, © 1990.

(List continued on next page.)

*Primary Examiner*—Rinaldi I. Rada
*Assistant Examiner*—Sameh Tawfik
(74) *Attorney, Agent, or Firm*—Dunlap, Codding & Rogers

(57) ABSTRACT

A decorative cover or container for holding a flower pot, floral grouping or botanical item, and constructed from a sheet of material having a plurality of folded portions, wherein the decorative cover or container is initially constructed in a flattened condition, and having a base portion which is opened to expose an interior space into which a pot or floral grouping can be disposed, and having a bottom having bottom folds secured by a bottom fold securing element.

18 Claims, 6 Drawing Sheets

U.S. PATENT DOCUMENTS

| | | | | |
|---|---|---|---|---|
| 3,550,318 | A | 12/1970 | Remke et al. | 47/37 |
| 3,556,389 | A | 1/1971 | Gregoire | 229/53 |
| 3,767,104 | A | 10/1973 | Bachman et al. | 229/7 |
| 3,962,503 | A | 6/1976 | Crawford | 428/40 |
| 4,043,077 | A | 8/1977 | Stonehocker | 47/66 |
| 4,091,925 | A | 5/1978 | Griffo et al. | 206/423 |
| 4,118,890 | A | 10/1978 | Shore | 47/28 |
| 4,189,868 | A | 2/1980 | Tymchuck et al. | 47/84 |
| 4,248,347 | A | 2/1981 | Trimbee | 206/423 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,333,267 | A | 6/1982 | Witte | 47/84 |
| 4,347,686 | A | 9/1982 | Wood | 47/73 |
| 4,400,910 | A | 8/1983 | Koudstaal et al. | 47/84 |
| 4,413,725 | A | 11/1983 | Bruno et al. | 206/45.33 |
| 4,621,733 | A | 11/1986 | Harris | 206/423 |
| 4,640,079 | A | 2/1987 | Stuck | 53/390 |
| 4,733,521 | A | 3/1988 | Weder et al. | 53/580 |
| 4,773,182 | A | 9/1988 | Weder et al. | 47/72 |
| 4,801,014 | A | 1/1989 | Meadows | 206/423 |
| 4,810,109 | A | 3/1989 | Castel | 383/105 |
| D301,991 | S | 7/1989 | Van Sant | D11/149 |
| 4,941,572 | A | 7/1990 | Harris | 206/423 |
| 4,989,396 | A | 2/1991 | Weder et al. | 53/397 |
| D315,700 | S | 3/1991 | Stephens | D11/151 |
| 5,073,161 | A | 12/1991 | Weder et al. | 493/154 |
| 5,105,599 | A | 4/1992 | Weder | 53/399 |
| 5,111,638 | A | 5/1992 | Weder | 53/397 |
| 5,181,364 | A | 1/1993 | Weder | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,307,606 | A | 5/1994 | Weder | 53/410 |
| 5,315,785 | A | 5/1994 | Avôet al. | 47/72 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,551,570 | A | 9/1996 | Shaffer et al. | 206/575 |
| 5,572,849 | A | 11/1996 | Weder et al. | 53/399 |
| 5,572,851 | A | 11/1996 | Weder | 53/399 |
| 5,617,703 | A | 4/1997 | Weder | 53/413 |
| 5,624,320 | A | 4/1997 | Martinez | 472/51 |
| 5,625,979 | A | 5/1997 | Weder | |
| 5,647,168 | A | 7/1997 | Gilbert | 47/72 |
| 5,647,193 | A | 7/1997 | Weder et al. | 53/465 |
| 5,715,944 | A | 2/1998 | Windisch | 206/423 |
| 5,842,630 | A | 12/1998 | Remer | |
| D404,684 | S | 1/1999 | Shea | D11/164 |
| 5,974,730 | A | 11/1999 | Chien | 47/41.01 |
| D419,436 | S | 1/2000 | Celtorius et al. | D9/305 |
| 6,129,208 | A | 10/2000 | Ferguson | 206/423 |
| 6,129,209 | A | 10/2000 | Tchira | 206/423 |

FOREIGN PATENT DOCUMENTS

| | | |
|---|---|---|
| DE | 15550 | 6/1900 |
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| EP | 0791543 | 8/1997 |
| FR | 2036163 | 12/1970 |
| FR | 2137325 | 12/1972 |
| FR | 2603159 | 3/1989 |
| FR | 2619698 | 3/1989 |
| GB | 5605 | 5/1885 |
| GB | 155723 | 12/1920 |
| GB | 1204647 | 9/1970 |
| GB | 2056410 | 3/1981 |
| GB | 2074542 | 11/1981 |
| IT | 224507 | 4/1996 |
| NL | 8301709 | 12/1984 |
| NL | 1000658 | 1/1996 |
| WO | 9315979 | 8/1993 |
| WO | PCT/US03/04583 | 7/2003 |

OTHER PUBLICATIONS

"Color Them Happy with Highlander Products" © 1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec., 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows, in one embodiment , a vase with flowers inside a "cut flower" sleeve with the sleeve tied with a ribbon about the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.
"Send Collection Sleeve", Commercially available at least one year prior to the filing date.

FLAT PANEL SLEEVE WITH FOLDED PORTIONS AND METHOD OF MANUFACTURING

CROSS REFERENCE TO RELATED INFORMATION

Not Applicable.

FIELD OF THE INVENTION

This invention relates to sleeves, covers or containers used to wrap flower pots, contain or display floral groupings, or cultivate or display botanical items and methods of use thereof and methods of their manufacture.

DETAILED DESCRIPTION OF THE INVENTION

Figure 1:
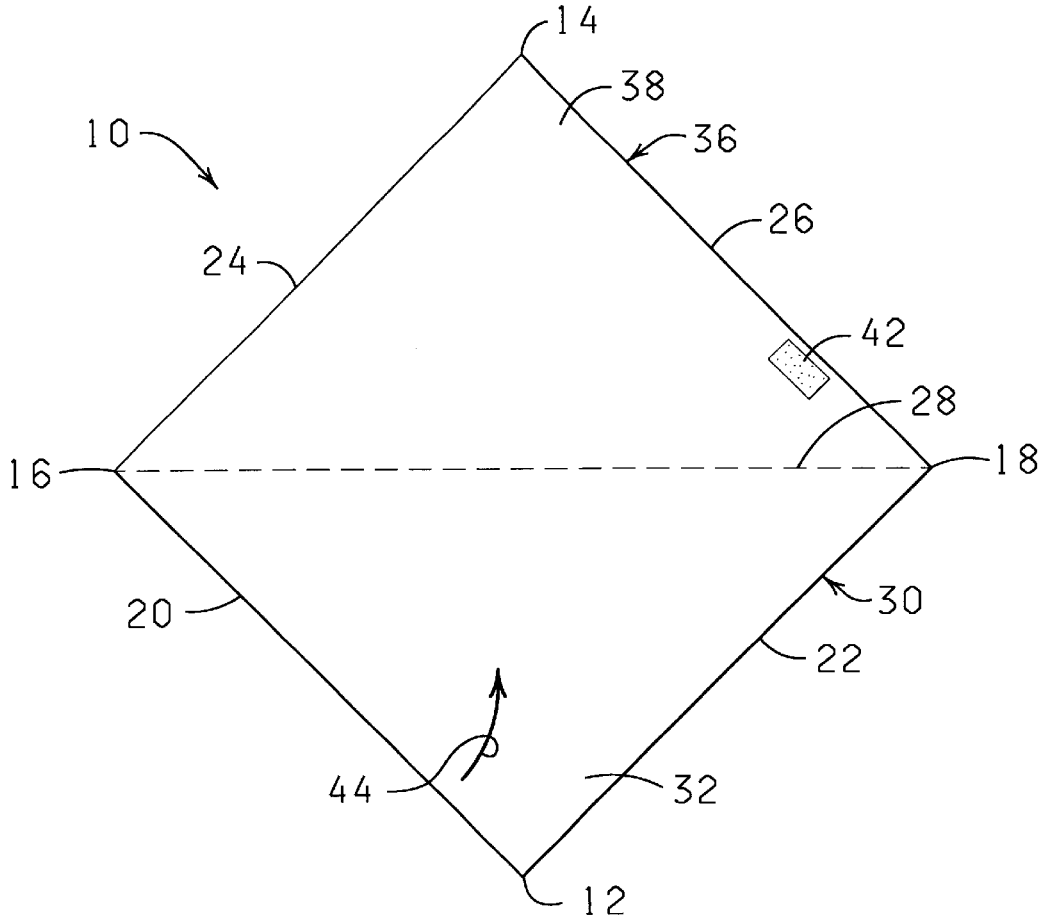
FIG. 1 is a plan view of a square sheet of material used to form a decorative cover in accordance with the present invention.

The present invention contemplates a floral cover which is manufactured from a flat sheet of material by folding and securing portions of the sheet of material in a particular sequence into the shape of a tubular sleeve which is then formed into an opened container to contain a pot, floral grouping, botanical item or growing material. It will be appreciated that the examples of the invention provided herein are not intended to limit the scope and extent of the claimed invention but are only intended to exemplify various of the embodiments of the invention contemplated herein.

Referring now to the drawings, FIGS. 1–9 show a process of folding a sheet of material 10 into a decorative cover 108 (FIGS. 8–11) which can be used to contain a potted plant, floral grouping or botanical item.

The sheet of material 10 (also referred to herein as sheet 10) shown in FIG. 1 and in FIGS. 2–9 in various stages of folding, has a first apex 12, a second apex 14, a third apex 16, a fourth apex 18, a first edge 20, a second edge 22, a third edge 24, and a fourth edge 26. The sheet 10 has a first fold line 28 (which may or may not constitute an actual crease or scored line) which extends between third apex 16 and fourth apex 18. The first fold line 28 effectively separates the sheet 10 into a first triangular portion 30 which comprises the portion of sheet 10 between the first fold line 28 and the first apex 12, and a second triangular portion 36 which comprises the portion of the sheet 10 between the first fold line 28 and the second apex 14. The first triangular portion 30 has an inner surface 32 and an outer surface 34 (e.g., FIG. 2). The second triangular portion 36 has an inner surface 38 and an outer surface 40 (e.g., FIG. 3). A first connecting bonding material 42 such as an adhesive is disposed upon a portion of the inner surface 38 of the second triangular portion 36, preferably near the fourth apex 18 for bondingly connecting the first triangular portion 30 to the second triangular portion 36. Alternatively, the first connecting bonding material 42 could be disposed upon a portion of the inner surface 32 of the first triangular portion 30 for bonding the first triangular portion 30 to the second triangular portion 36. Alternately, when the first connecting bonding material 42 is a cohesive material, it may be disposed on portions of both the first triangular portion 30 and second triangular portion 36.

Figure 2:
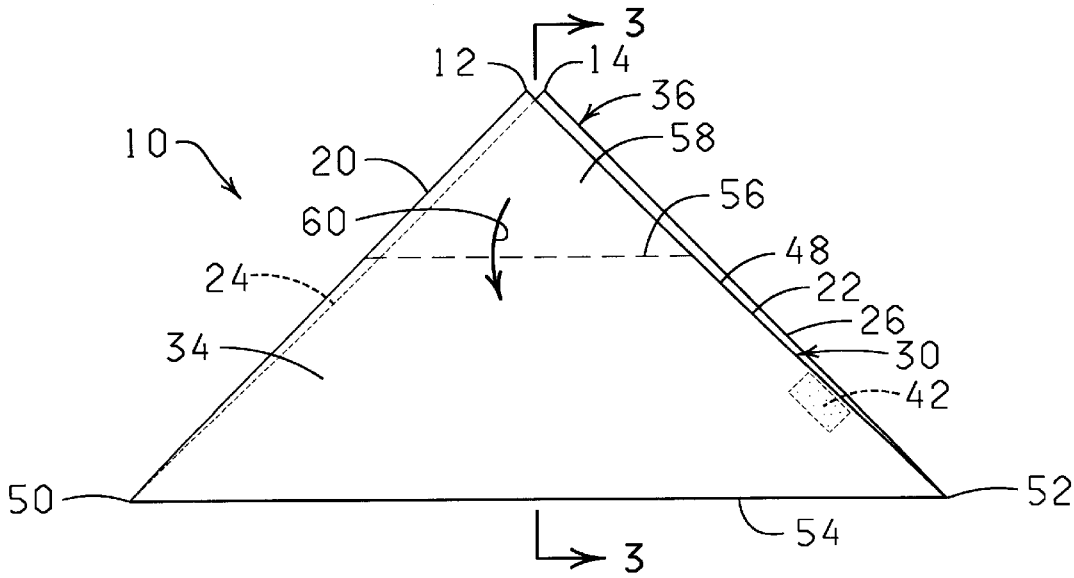
FIG. 2 is an elevational view of the sheet of material of FIG. 1 having a first folded portion.
Figure 3:
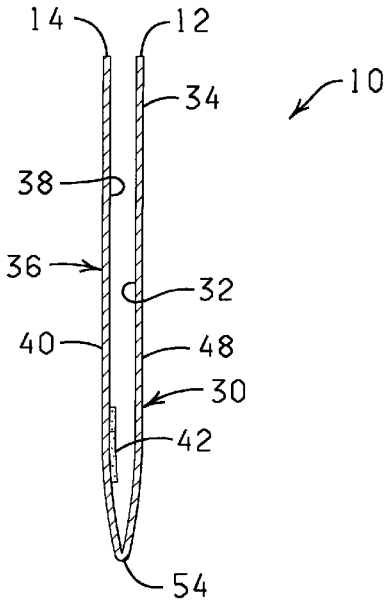
FIG. 3 is a cross-sectional view of the sheet of material of FIG. 2 taken along line 3—3.

In a first folding step, the first triangular portion 30 is folded upon the second triangular portion 36 in a direction 44 resulting in the sheet 10 being folded into two triangular halves: a first folded portion 48 and the second triangular portion 36, as shown in FIGS. 2 and 3. The first folded portion 48 is the first triangular portion 30. The sheet 10, now folded, has a first corner 50, generally in the same location as the third apex 16 and, a second corner 52, generally in the same location as the fourth apex 18. The connecting bonding material 42 connects the first folded portion 48 to the second triangular portion 36. The first edge 20 is adjacent and parallel to the third edge 24, and the second edge 22 is adjacent and parallel to the fourth edge 26. The first apex 12 is adjacent the second apex 14. A bottom edge 54 of the sheet 10 extends between first corner 50 and second corner 52.

Figure 5:
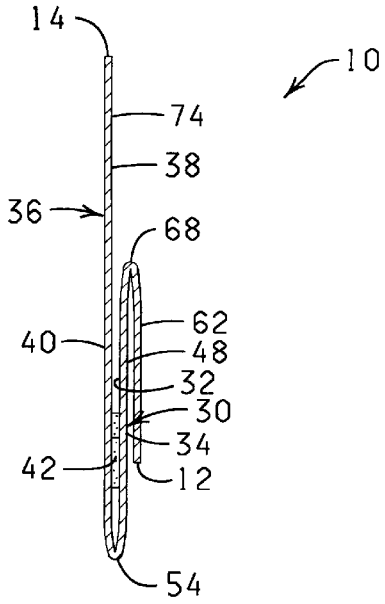
FIG. 5 is a cross-sectional view of the sheet of material of FIG. 4 taken along line 5—5.
Figure 4:
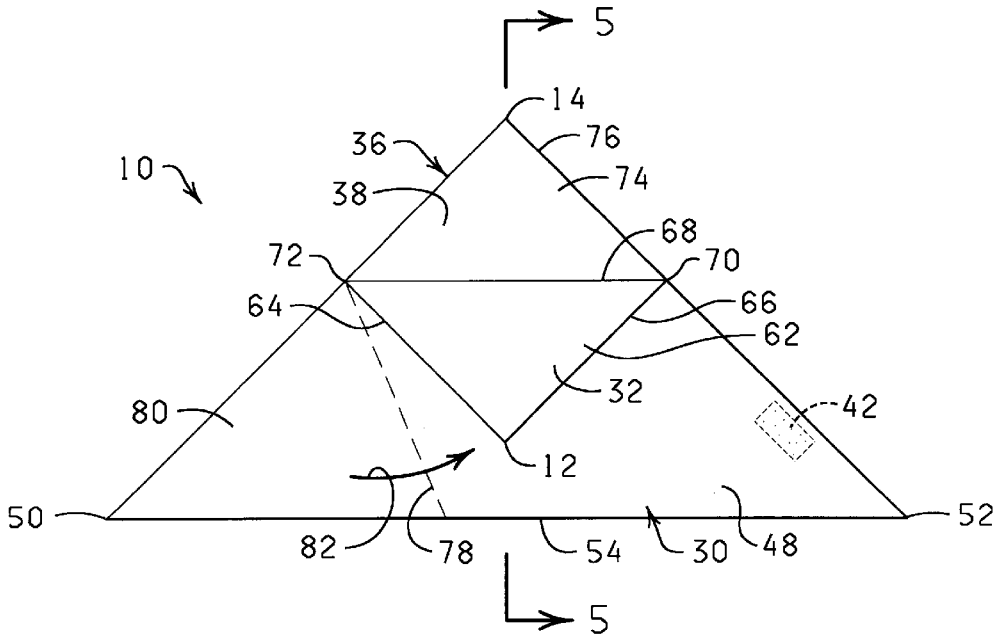
FIG. 4 is an elevational view of the sheet of material of FIG. 2 having a second folded portion.
Figure 6:
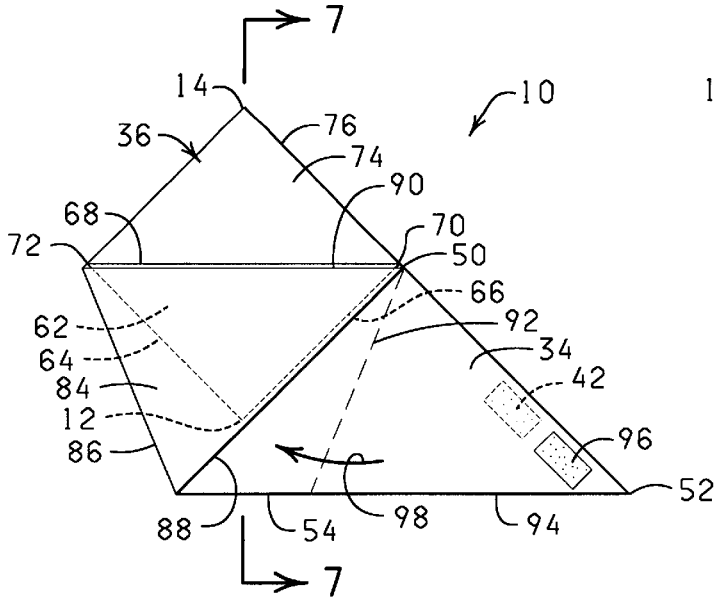
FIG. 6 is an elevational view of the sheet of material of FIG. 4 having a third folded portion.
Figure 7:
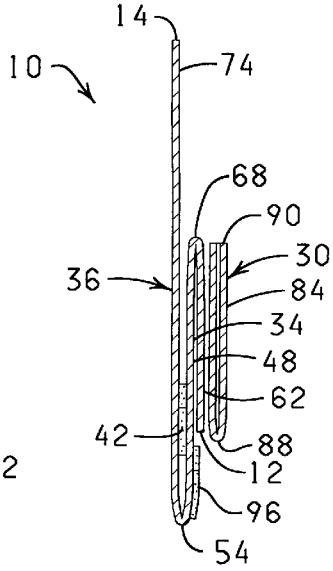
FIG. 7 is a cross-sectional view of the sheet of material of FIG. 6 taken along line 7—7.
Figure 8:
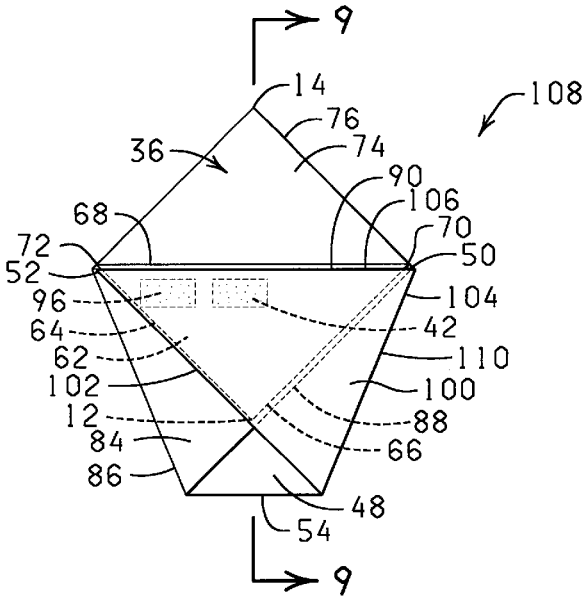
FIG. 8 is an elevational view of the sheet of material of FIG. 6 having a fourth folded portion forming a decorative cover.
Figure 9:
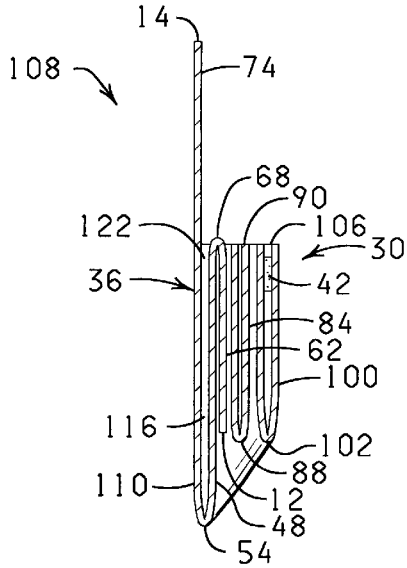
FIG. 9 is a cross-sectional view of the decorative cover formed by the sheet of material of FIG. 8 taken along line 9—9.

A second fold line 56 (which may or may not constitute an actual crease or score line) extends between first edge 20 and second edge 22 in the first folded portion 48. The portion of the first folded portion 48 between first apex 12 and the second fold line 56 comprises an upper triangular portion 58. In a second folding step, the upper triangular portion 58 is folded in a second direction 60 to lie against a portion of the outer surface 34 of the first folded portion 48 to form a second folded portion 62 (FIGS. 4 and 5). The second folded portion 62 (also referred to herein as the "apical portion") has a left edge 64, a right edge 66, an upper edge 68, a first corner 70 and a second corner 72. When the second folded portion 62 in the first folded portion 48 is formed, a skirt portion 74 is formed in a portion of the first triangular portion 36 between the second apex 14 and the upper edge 68 of the second folded portion 62, the skirt portion 74 has an edge 76.

A third fold line 78 (which may or may not constitute an actual crease or score line) extends in the first folded portion 48 and the second triangular portion 36 between the second corner 72 of the second folded portion 62 and the bottom edge 54. The portions of the first folded portion 48 and the second triangular portion 36 which extend between first corner 50 and third fold line 78 comprise a left triangular portion 80. In a third folding step, the left triangular portion 80 is folded in direction 82 wherein first corner 50 is disposed generally adjacent the first corner 70 of the second folded portion 62 wherein the left triangular portion 80 forms a third folded portion 84 (FIGS. 6–7) and which is also referred to herein as the first corner portion, which entirely or substantially covers second folded portion 62 and a portion of the outer surface 34 of the first folded portion 48. The third folded portion 84 has a left edge 86, a right edge 88 which extends from first corner 70 of the second folded portion 62 to the bottom edge 54, and an upper edge 90 which is adjacent and generally parallel to the upper edge 68 of the second folded portion 62.

A fourth fold line 92 (which may or may not constitute an actual crease or score line) in the first folded portion 48 and the second triangular portion 36 extends between the first corner 70 of the second folded portion 62 and the bottom edge 54. The portions of the first folded portion 48 and the second triangular portion 36 which extend between the second corner 52 and the fourth fold line 92 comprise a right triangular portion 94.

Disposed upon a portion of the outer surface 34 of the right triangular portion 94 is a second connecting bonding material 96 preferably near second corner 52. The second connecting bonding material 96 is preferably disposed on the right triangular portion 94 but may alternatively be disposed upon an exposed surface portion of the third folded portion 84. The second connecting bonding material 96 may alternately be disposed upon portions of both the right triangular portion 94 and the third folded portion 84, for example when the second connecting bonding material 96 is a cohesive material. In a fourth folding step the right triangular portion 94 is folded in direction 98 wherein second corner 52 is disposed generally adjacent second corner 72 of the second folded portion 62 wherein the right triangular portion 94 forms a fourth folded portion 100 (FIGS. 8 and 9) and which is also referred to herein as the second corner portion, which covers a portion of the third folded portion 84 and a portion of the outer surface 34 of the first folded portion 48. The fourth folded portion 100 has a left edge 102 which extends from near the second corner 72 of second folded portion 62 to the bottom edge 54, a right edge 104, and an upper edge 106 which is adjacent and generally parallel to upper edge 90 of the third folded portion 84. The fourth folded portion 100 is connected to the third folded portion 84 via the second connecting bonding material 96. It will be understood by a person of ordinary skill in the art that the second connecting bonding material 96 may not be applied until just before the right triangular portion 94 is folded to form the fourth folded portion 100, or it may be applied to a portion of the sheet 10 well before the forming of the fourth folded portion 100, in a manner similar to the sheet 10 in the embodiment shown in FIGS. 1, 2 or 4.

Figure 10:
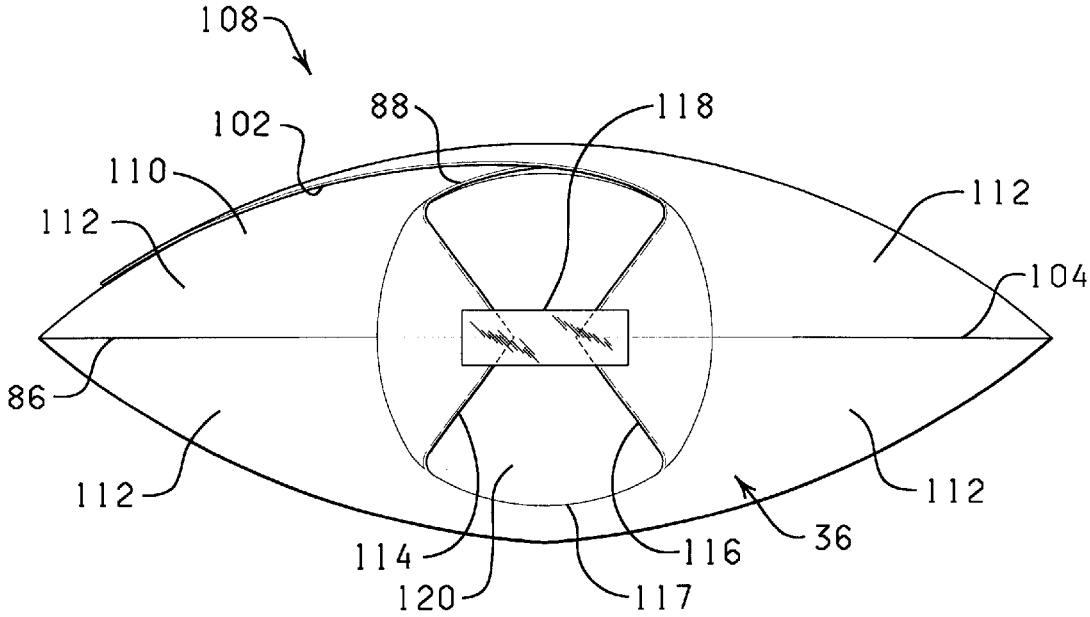
FIG. 10 is a bottom view of the decorative cover of FIG. 8 after it is formed into an open position.
Figure 11:
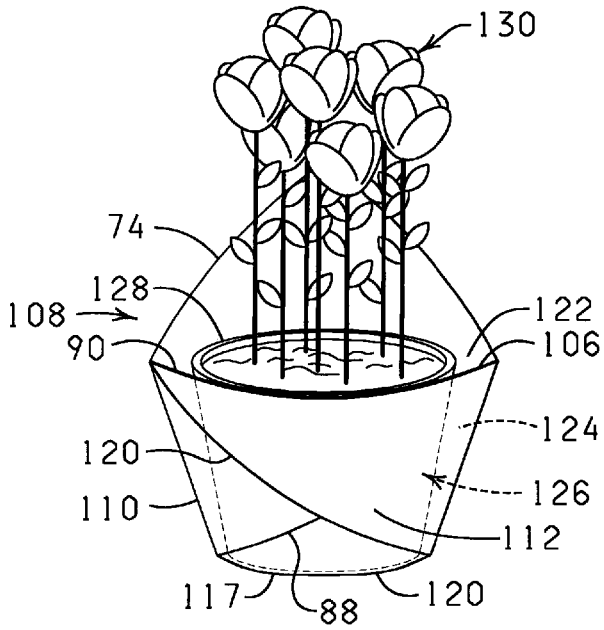
FIG. 11 is a perspective view of the opened decorative cover of FIG. 10 having a pot and floral grouping disposed therein.

The fourth folding step results in the sheet 10 having been formed into a decorative cover 108 (FIGS. 8–11) which comprises essentially two components, a base portion 110 constructed from the first, second, third and fourth folded portions 48, 62, 84 and 100, respectively, and the skirt portion 74 which extends generally from the base portion 110, and beyond the upper edge 106 of the fourth folded portion 100. The base portion 110 preferably has a tapered, or frustoconical sidewall 112 when opened as shown in FIGS. 10 and 11. FIG. 10 shows a bottom view of the decorative cover 108 expanded from a flat condition to an opened condition.

The decorative cover 108 is opened manually or automatically and in a preferred embodiment is disposed over a pot-shaped mold or mandrel (not shown). Once disposed upon the mold or mandrel, the decorative cover 108 can be secured in an opened position by forming a first bottom fold 114 and a second bottom fold 116 in a lower end 117 of the decorative cover 108. The first bottom fold 114 and the second bottom fold 116 are secured by a bottom fold securing element 118 such as a tape, adhesive material, or heat seal thereby forming a substantially flat bottom 120 in the decorative cover 108. The decorative cover 108 is thereby formed into an opened position and has an upper opening 122 and an inner retaining space for containing a pot 126, which has an upper rim 128. A plurality of the decorative covers 108 thus formed can be stacked to form a nested set of decorative covers 108 for shipping.

As noted, the decorative cover 108 has an inner retaining space 124 (also referred to herein as an interior space) into which the pot 126 having a floral grouping 130 has been disposed. The skirt portion 74 extends a distance above an upper rim 128 of the pot 126 and the upper edge 106 is positioned, preferably, near a portion of the upper rim 128 of the pot 126.

FIGS. 1–9 show how the square sheet of material 10 is formed into the decorative cover 108 (also referred to herein simply as a "cover") having the skirt portion 74, however, it will be apparent to a person of ordinary skill in the art that sheets of material having other shapes (non-square) could also be used to form decorative covers in accordance with the methods designed herein. Examples of such sheets of material and the decorative covers formed therefrom are shown in FIGS. 12–17.

Figure 12:
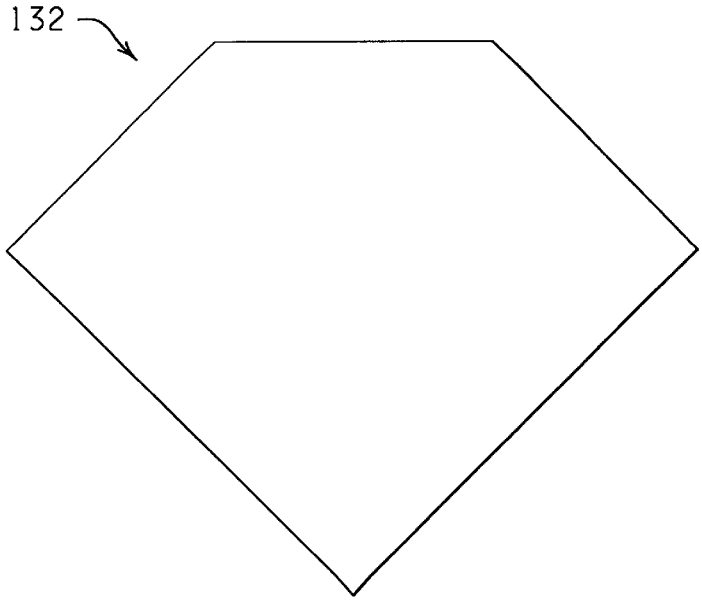
FIG. 12 is a plan view of an alternate version of a sheet of material used to form a decorative cover in accordance with the present invention.
Figure 13:
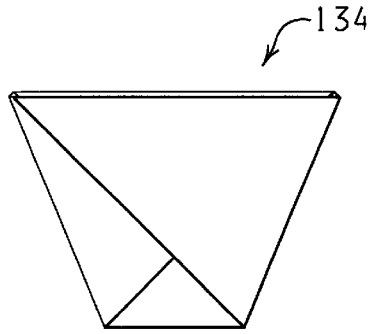
FIG. 13 is an elevational view of a decorative cover formed using the sheet of material of FIG. 12.

Shown in FIG. 12 is a sheet of material 132 having a pentagonal shape (a truncated square) which when formed into a decorative cover 134 (FIG. 13) in the manner described herein lacks a skirt portion similar to the skirt portion 74 of decorative cover 108.

Figure 14:
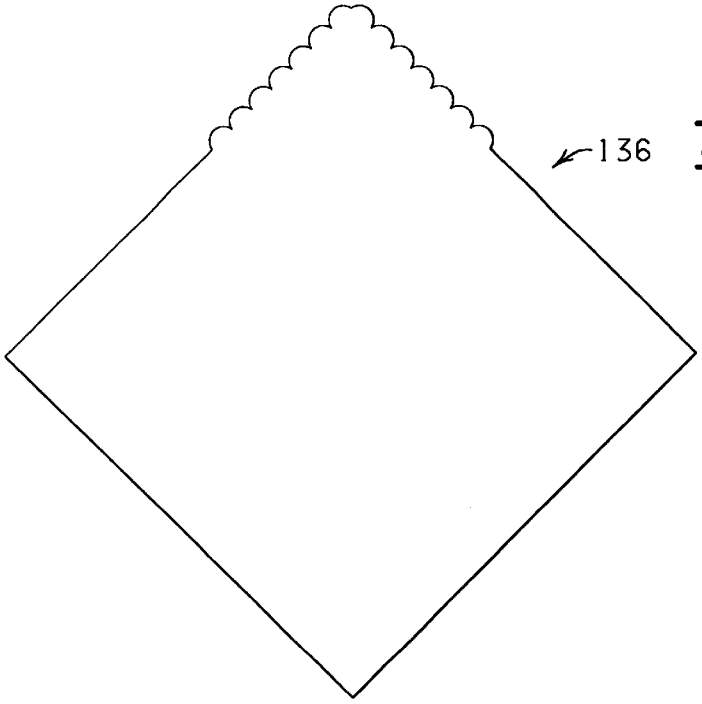
FIG. 14 is a plan view of an alternate version of a sheet of material used to form a decorative cover in accordance with the present invention.
Figure 15:
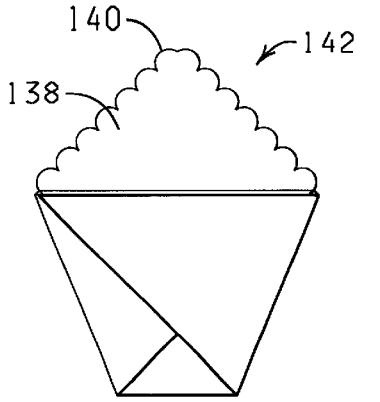
FIG. 15 is an elevational view of a decorative cover formed using the sheet of material of FIG. 14.
Figure 16:
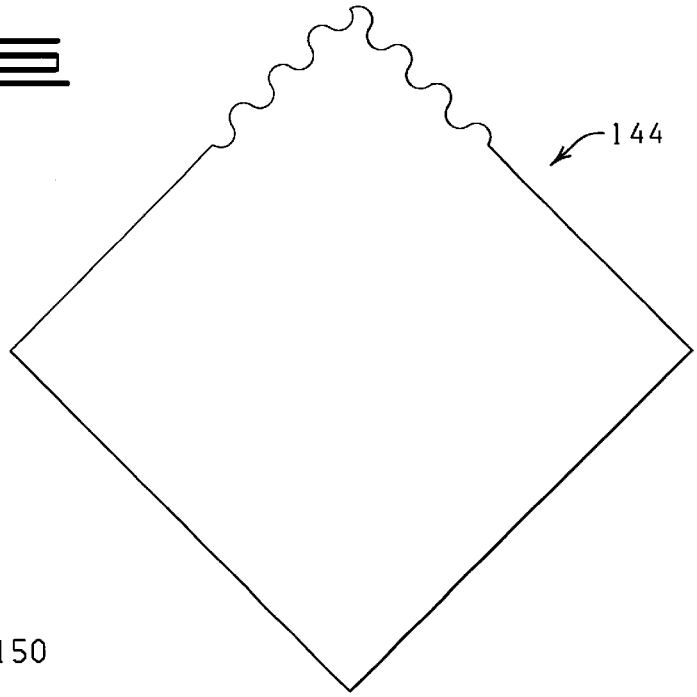
FIG. 16 is a plan view of an alternate version of a sheet of material used to form a decorative cover in accordance with the present invention.
Figure 17:
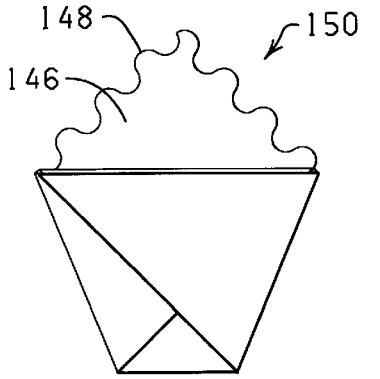
FIG. 17 is an elevational view of a decorative cover formed using the sheet of material of FIG. 16.

Shown in FIG. 14 is a sheet of material 136 which when formed into a decorative cover 142 in the manner described herein has a skirt portion 138 which has a non-linear or curved edge 140 (FIG. 15). Shown in FIG. 16 is a sheet of material 144 which when formed into a decorative cover 150 has a skirt portion 146 which has a non-linear or curved edge 148 (FIG. 17) which has a different configuration than curved edge 140.

Any of the embodiments of decorative covers 108, 134, 142, or 150 described herein, or any other decorative covers which may be constructed by the methods described herein, may have other structural or decorative features.

The decorative covers 108, 134, 142, or 150 may comprise a bonding material (not shown) disposed on an inner portion thereof for bondingly connecting the decorative covers 108, 134, 142, or 150 to the pot 126 disposed therein. Or, a bonding material (not shown) may be disposed on an outer surface thereof for securing a plurality of crimped folds formed in the decorative covers 108, 134, 142, or 150.

The skirt portions 74, 138 or 146 may be adapted so the decorative covers 108, 134, 142, or 150, respectively, can be supported via a support assembly such as a wicket (for example, by having apertures therein). Such devices for supporting flattened covers such as floral sleeves are well known in the art. Any of the decorative covers 108, 134, 142, or 150 may be equipped with drainage holes, and may be constructed from water permeable or impermeable materials.

The material from which the decorative covers 108, 134, 142, or 150 are constructed preferably has a thickness in a range from about 0.1 mil to about 30 mils. Often, the thicknesses of the material employed to construct the decorative covers 108, 134, 142, or 150 are in a range from about 0.5 mil to about 10 mils or preferably, in a range from about 1.0 mil to about 5 mils. Preferably, the decorative covers 108, 134, 142, or 150 are constructed from a material which is flexible, semi-rigid, rigid, or any combination thereof. The decorative covers herein before described may be constructed of a single layer of material or a plurality of layers of the same or different types of materials. Any thickness of the material may be utilized as long as the material functions in accordance with the present invention as described herein. The layers of material comprising the decorative covers may be connected together or laminated or may be separate layers. Such materials used to construct said decorative covers are described in U.S. Pat. No. 5,111,637, which is hereby expressly incorporated herein by reference. However, any thickness of material may be utilized in accordance with the present invention as long as the decorative covers may be formed as described herein. Additionally, an insulating material such as bubble film, preferable as one of two or more layers, can be utilized in order to provide additional protection for the item, such as the floral grouping, contained therein.

The decorative covers 108, 134, 142, or 150 are constructed from any suitable sheet of material that is capable of being folded into such a decorative cover. Preferably, the material comprises treated or untreated paper, metal foil, polymeric film, non-polymeric film woven, or nonwoven fabric, or synthetic or natural fabric, cardboard, fiber, cloth, burlap, or laminations or combinations thereof.

The term "polymeric film" when used herein means a film made of a synthetic polymer such as a polypropylene or a naturally occurring polymer such as cellophane. A polymeric film is relatively strong and not as subject to tearing (substantially non-tearable), as might be the case with paper or foil.

In one embodiment, the decorative cover 108, 134, 142, or 150 may be constructed from sheets comprising one or two polypropylene films. The two polypropylene films may be connected together or laminated or may be separate layers.

The materials comprising the decorative covers 108, 134, 142, or 150 may vary in color and as described herein consist of designs or decorative patterns which are printed, etched, and/or embossed thereon using inks or other printing materials well known in the art.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination. The material may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, foam, and including the nutrients, fertilizers or hormones or combinations thereof required by the plants or propagules for growth.

The term "botanical item" when used herein means a natural or artificial herbaceous or woody plant or mushroom, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquets or floral grouping s.

The term "propagule" when used herein means any structure capable of being propagated or acting as an agent of reproduction including seeds, shoots, stems, runners, tubers, plants, leaves, roots, or spores.

The term "pot" as used herein refers to any type of container used for holding a floral grouping, botanical item, or plant, including vases. Examples of pots, used in accordance with the present invention include, but not by way of limitation, clay pots, wooden pots, foam pots, plastic pots, pots made from natural and/or synthetic fibers, or materials and/or any combination thereof. As used herein, the term "pot" preferably means a standard flower pot such as a 3-inch, 3½-inch, 4-inch, 4½-inch, 5-inch, 5½-inch, 6-inch, 6½-inch, 7-inch or 8-inch pot for example, or any other pot typically commercially available. The pot is adapted to receive a floral grouping in a retaining space thereof. The floral grouping may be disposed within the pot along with a suitable growing medium described elsewhere herein, or other retaining medium, such as a floral foam. It will also be understood that a floral grouping, botanical item or propagule and any appropriate growing medium or other retaining medium, may be disposed in the decorative cover 108, 134, 142, or 150 without a pot for displaying, transporting or cultivating the item disposed within the decorative covers 108, 134, 142, or 150.

It should be further noted that various features of the versions of the present invention such as described herein as well as, handles or handle apertures, additional perforations, and ventilation holes, may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A method of forming a decorative cover or a container, comprising:

providing a sheet of material;

folding a portion of the sheet of material along a first fold line extending from a first corner of the sheet of material to a second corner of the sheet of material forming a first folded portion in the sheet of material;

folding an apical portion of the first folded portion along a second fold line in the first folded portion forming a second folded portion, the second folded portion having an upper edge and being folded against a portion of the first folded portion;

folding a first corner portion of the first folded portion along a third fold line forming a third folded portion which has an upper edge and which substantially covers the second folded portion;

folding a second corner portion of the first folded portion along a fourth fold line forming a fourth folded portion which has an upper edge and which covers at least a portion of the third folded portion;

connecting the fourth folded portion to the third folded portion;

opening the decorative cover or container thereby formed to expose an interior space into which a pot or a botanical item can be disposed;

forming a first bottom fold and a second bottom fold in a lower end of the opened decorative cover or container; and connecting the first bottom fold and the second bottom fold to a portion of a lower end in the opened decorative cover or container via a bottom fold securing element forming a bottom in the opened decorative cover or container.

2. The method of claim 1 wherein in the step of folding a second corner portion, the upper edge of the second folded portion, the upper edge of the third folded portion, and the upper edge of the fourth folded portion are generally parallel to each other.

3. The method of claim 1 wherein in the step of folding a portion of the sheet of material along a first fold line also includes the step of bondingly connecting the first folded portion to an adjacent portion of the sheet of material.

4. The method of claim 1 wherein in the step of connecting the fourth folded portion, the fourth folded portion is connected to the third folded portion via a connecting bonding material, wherein the connecting bonding material is selected from the group consisting of an adhesive material, a cohesive material, tape, staples, clips, heat sealing materials, sonic sealing materials, vibratory sealing materials and labels.

5. The method of claim 1 wherein in the step of providing a sheet of material, the sheet of material is constructed from a material selected from the group consisting of treated or untreated paper, metal foil, plastic, polymeric film, non-polymeric film, cardboard, fiber, cloth, burlap, and laminations or combinations thereof.

6. The method of claim 1 wherein in the step of providing a sheet of material, the sheet of material is defined as constructed from a material having a thickness in a range of from about 0.1 mil to about 30 mils.

7. The method of claim 1 wherein in the step of connecting the fourth portion, the decorative cover or container further comprises a base portion and a skirt portion, the base portion having the interior space, and the skirt portion extending from the base portion.

8. The method of claim 7 wherein the skirt portion has a non-linear edge.

9. The method of claim 7 wherein the base portion has a frustoconical shape when in the opened position.

10. A decorative cover or container produced by the method comprising the steps of:

providing a sheet of material;

folding a portion of the sheet of material along a first fold line extending from a first corner of the sheet of material to a second corner of the sheet of material forming a first folded portion in the sheet of material;

folding an apical portion of the first folded portion along a second fold line in the first folded portion forming a second folded portion, the second folded portion having an upper edge and being folded against a portion of the first folded portion;

folding a first corner portion of the first folded portion along a third fold line forming a third folded portion which has an upper edge and which substantially covers the second folded portion;

folding a second corner portion of the first folded portion along a fourth fold line forming a fourth folded portion which has an upper edge and which covers at least a portion of the third folded portion;

connecting the fourth folded portion to the third folded portion;

opening the decorative cover or container thereby formed can be opened to expose an interior space into which a pot or a botanical item can be disposed;

forming a first bottom fold and a second bottom fold in a lower end of the opened decorative cover or container; and connecting the first bottom fold and the second bottom fold to a portion of a lower end in the opened decorative cover or container via a bottom fold securing element forming a bottom in the opened decorative cover or container.

11. The decorative cover or container of claim 10 wherein the upper edge of the second folded portion, the upper edge of the third folded portion, and the upper edge of the fourth folded portion are generally parallel to each other.

12. The decorative cover or container of claim 10 wherein the first folded portion is bondingly connected to an adjacent portion of the sheet of material.

13. The decorative cover or container of claim 10 wherein the fourth folded portion is connected to the third folded portion via a connecting bonding material, wherein the connecting bonding material is selected from the group consisting of an adhesive material, a cohesive material, tape, staples, clips, heat sealing materials, sonic sealing materials, vibratory sealing materials and labels.

14. The decorative cover or container of claim 10 constructed from a material selected from the group consisting of treated or untreated paper, metal foil, plastic, polymeric film, non-polymeric film, cardboard, fiber, cloth, burlap, and laminations of combinations thereof.

15. The decorative cover or container of claim 10 wherein the sheet of material is defined as constructed from a material having a thickness in a range of from about 0.1 mil to about 30 mils.

16. The decorative cover or container of claim 10 further comprising a base portion and a skirt portion, the base portion having the interior space, and the skirt portion extending from the base portion.

17. The decorative cover or container of claim 16 wherein the skirt portion has a non-linear edge.

18. The decorative cover or container of claim 16 wherein the base portion has a frustoconical shape in the opened position.

* * * * *